US010123575B2

(12) United States Patent
Funk-Danielson et al.

(10) Patent No.: US 10,123,575 B2
(45) Date of Patent: Nov. 13, 2018

(54) BRA WITH SUPPORT PORTIONS

(71) Applicant: NIKE, Inc., Beaverton, OR (US)

(72) Inventors: Brenda K. Funk-Danielson, Portland, OR (US); Matthew D. Nordstrom, Portland, OR (US); Laura Tempesta, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/016,401

(22) Filed: Feb. 5, 2016

(65) Prior Publication Data

US 2016/0227846 A1 Aug. 11, 2016

Related U.S. Application Data

(60) Provisional application No. 62/112,876, filed on Feb. 6, 2015.

(51) Int. Cl.
*A41C 3/12* (2006.01)
*A41C 3/00* (2006.01)

(52) U.S. Cl.
CPC ..... *A41C 3/128* (2013.01); *A41C 3/0007* (2013.01)

(58) Field of Classification Search
CPC ..... A41C 3/00; A41C 3/0007; A41C 3/0014
USPC ..... 450/41–45, 39
See application file for complete search history.

(56) References Cited

U.S. PATENT DOCUMENTS 3,548,832 A 12/1970 Rosner
D300,980 S 5/1989 Mathis
D301,933 S 7/1989 Akazaki
D381,188 S 7/1997 Allen
5,967,877 A 10/1999 Howard
6,332,825 B1 * 12/2001 Henricksen ..... A41C 3/0057 450/1
6,435,939 B1 * 8/2002 Lin ..... A41C 3/128 450/41
6,439,959 B1 8/2002 Magrone et al.
6,966,815 B2 11/2005 Weinerth
7,309,276 B2 12/2007 Legaspi et al.
7,435,156 B1 * 10/2008 Liu ..... A41C 3/0014 450/39
7,604,526 B2 10/2009 Liu
(Continued)

FOREIGN PATENT DOCUMENTS

CN 2701275 Y 5/2005
CN 102215797 A 10/2011
(Continued)

OTHER PUBLICATIONS

International Search Report and Written Opinion dated Jun. 20, 2016 for International Patent Application PCT/US2016/016937, 18 pages.
(Continued)

*Primary Examiner* — Gloria Hale
(74) *Attorney, Agent, or Firm* — Shook, Hardy and Bacon LLP

(57) ABSTRACT

A bra having one or more flexible elastomeric support strips is provided herein. The support strips are affixed to one or more of an outer-facing surface of the breast cups of the bra or to an inner-facing surface of the breast cups of the bra such that they provide support to at least the under portions of a wearer's breasts.

16 Claims, 5 Drawing Sheets

(56) References Cited

U.S. PATENT DOCUMENTS

| | | | | |
|---|---|---|---|---|
| 7,833,082 | B2 * | 11/2010 | Bugada | A41C 3/0014 450/39 |
| 7,862,401 | B2 * | 1/2011 | Watrin | A41C 3/0014 450/39 |
| D646,461 | S | 10/2011 | Lewando | |
| D658,353 | S | 5/2012 | Cage et al. | |
| 8,460,054 | B2 | 6/2013 | Swendseid | |
| 8,900,032 | B2 | 12/2014 | Punsal | |
| D735,970 | S | 8/2015 | Congdon | |
| D750,868 | S | 3/2016 | Randall | |
| 9,402,424 | B2 * | 8/2016 | Roy | A41C 5/005 |
| 9,516,905 | B2 * | 12/2016 | Pagnon | A41C 3/00 |
| 2005/0266770 | A1 * | 12/2005 | Henricksen | A41C 3/0007 450/1 |
| 2007/0298681 | A1 * | 12/2007 | Liu | A41C 3/0007 450/39 |
| 2007/0298682 | A1 * | 12/2007 | Liu | A41C 3/0014 450/39 |
| 2008/0073811 | A1 * | 3/2008 | Wan | A41C 3/122 264/241 |
| 2008/0076326 | A1 * | 3/2008 | Wan | A41C 3/142 450/41 |
| 2008/0090491 | A1 * | 4/2008 | Liu | A41C 3/0014 450/39 |
| 2008/0274669 | A1 * | 11/2008 | Liu | A41C 3/0007 450/52 |
| 2009/0271914 | A1 * | 11/2009 | Bauer | A41B 9/001 2/401 |
| 2010/0114328 | A1 | 5/2010 | Milblocker et al. | |

FOREIGN PATENT DOCUMENTS

| | | | |
|---|---|---|---|
| CN | 202077593 | U1 | 12/2011 |
| CN | 104223394 | A | 12/2014 |
| DE | 202005017753 | U1 | 1/2006 |
| EP | 0734660 | A1 | 10/1996 |
| EP | 2823721 | A1 | 1/2015 |
| WO | 0108516 | A1 | 2/2001 |
| WO | 2009133469 | A1 | 11/2009 |

OTHER PUBLICATIONS

Office Action dated May 27, 2016 in Design U.S. Appl. No. 29/541,533, 6 pages.

Notice of Allowance dated Apr. 28, 2017 in U.S. Appl. No. 29/554,870, 7 pages.

International Preliminary Report on Patentability dated Aug. 17, 2017 in International Patent Application No. PCT/US2016/016937, 12 pages.

* cited by examiner

BRA WITH SUPPORT PORTIONS

CROSS-REFERENCE TO RELATED APPLICATIONS

The application having U.S. application Ser. No. 15/016,401, filed on Feb. 5, 2016, and entitled "Bra with Support Portions" claims the benefit of priority to U.S. Provisional Application Ser. No. 62/112,876, entitled "Bra with Support Portions," and filed on Feb. 6, 2015. The entirety of the aforementioned application is incorporated by reference herein.

FIELD

The present disclosure relates to a bra having support portions. Specifically, the present disclosure relates to a bra having one or more flexible elastomeric support strips located on either an outer-facing or an inner-facing surface of a breast cup.

BACKGROUND

Conventional bras may provide support through the use of underwires made of metals or hard plastics. Providing support by using underwires has a number of drawbacks. For instance, they can cause discomfort by pressing uncomfortably into the wearer's flesh. In addition, because typical underwires are made of metal or hard plastic, they are generally affixed to the bra by encasing the underwire between layers of bra material. The user of multiple layers of bra material not only adds to manufacturing costs and waste but also adds bulk and weight to the bra. Furthermore, the tip of the underwire may penetrate one or more of the layers and cause chaffing or other discomfort to the wearer. Traditional underwires, moreover, fail to flex and bend with the wearer again causing discomfort and limiting the wearer's range of movement.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects herein are directed towards a bra that provides support through the use of flexible elastomeric support strips that are bonded or affixed to an inner-facing surface and/or an outer-facing surface of a breast cup. The elastomeric support strips may be positioned towards a lower margin of the breast cup such that they provide support to the under portion of a wearer's breasts when the bra is worn. The support strips, moreover, may be configured to extend or curve upward in a lateral and/or medial direction such that the strips may also provide support to the lateral and medial sides of the wearer's breasts when the bra is worn. In another example, the support strips may be positioned along the shoulder strap area of the bra to help limit stretch in this area and to provide support to the wearer's breasts.

In an exemplary aspect, the breast cups of the bra may be formed of a single layer of material and the elastomeric supports strips may be positioned on an outer-facing surface of the breast cup such that the strips are exposed to an external environment when the bra is in an as-worn configuration, or the support strips may be positioned on an inner-facing surface of the breast cup such that they lie adjacent to the wearer's skin. In other words, the elastomeric support strips are not sandwiched between different layers of the bra material and/or covered by another layer of bra material. By not sandwiching the support strips between different layers of bra material, the number of layers used to construct the bra may be reduced down to, for example, the single layer described herein which decreases the weight and/or bulk of the bra. This may be advantageous from an athletic performance perspective.

In another exemplary aspect, the breast cup may comprise one or more layers of material, and the elastomeric support strips may be positioned on the outer-facing surface of the breast cup such that at least a portion of the strips are exposed to the external environment. In other words, at least a portion of the elastomeric strips may not be sandwiched between different layers of the bra material and/or covered by another layer(s) of bra material.

In yet another exemplary aspect, the breast cup may comprise one or more layers of material, and at least a portion of the elastomeric support strips may be positioned on the inner-facing surface of the breast cup such that they are directly adjacent to the wearer's skin when the bra is being worn. To put it another way, at least a portion of the elastomeric support strips in this aspect are not sandwiched between layers of bra material and/or covered by a layer(s) of bra material.

Continuing, in another exemplary aspect, the breast cup may comprise one or more layers of material and a first elastomeric support strip(s) may be positioned on the outer-facing surface of the breast cup and a second elastomeric support strip(s) may be positioned on the inner-facing surface of the breast cup. This configuration may provide an additional layer of support.

By positioning the elastomeric support strips on the outer-facing surface of the breast cup such that they are exposed, advantages may be obtained. For instance, the strips may interact in some way with an outer shirt material. As an example, the elastomeric strip(s) may have a surface texture and/or a property such as stickiness that may help to keep the outer shirt material from shifting or riding-up during movement. As another example, the support strip(s) may be colored such that it adds aesthetic appeal to the bra and/or the outer shirt material/bra combination. Moreover, the coloring may indicate a particular level of support provided by the bra and thereby make a consumer's shopping experience easier and less time-consuming.

When positioned on the inner-facing surface of the breast cup such that the strips are positioned next to a wearer's skin surface, properties of the elastomeric strips such as surface texture and/or stickiness may cause the strips to slightly adhere to the wearer's skin thereby helping to keep the bra from shifting during movement.

BRIEF DESCRIPTION OF THE DRAWINGS

Examples of the present invention are described in detail below with reference to the attached drawing figures, wherein.

DETAILED DESCRIPTION

Figure 1:
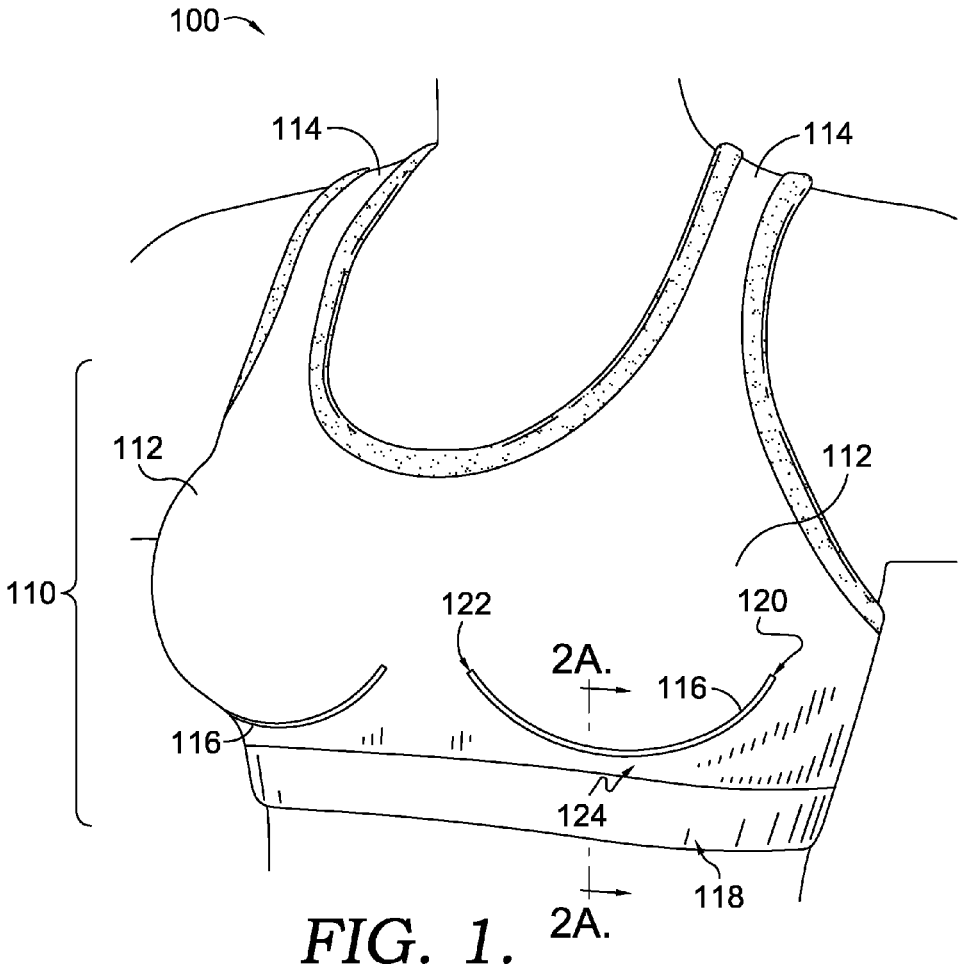
FIG. 1 illustrates a front perspective view of an exemplary bra having elastomeric support strips affixed to an outer-facing surface of the breast cups in accordance with an aspect herein.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein relate to a bra having one or more support portions. The support portions may comprise flexible elastomeric support strips that are affixed to an outer-facing surface and/or an inner-facing surface of the breast cups. To provide support to, for example, the under portions and/or the lateral/medial portions of a wearer's breasts when the bra is worn, the strips may be located on the breast cups such that they extend generally from a lateral side of the breast cup, down towards a lower margin of the breast cup, and up to a medial side of the breast cup such that the support strips may have a curved or arched shape. The strips may also be located on the shoulder portions of the bra to help limit stretch in this area and thus provide support to the wearer's breasts.

The elastomeric support strips may be configured to provide support in a number of different ways. For instance, the support strips may comprise a material that has a high modulus of elasticity such as, for example, thermoplastic polyurethane materials. Modulus of elasticity may be defined as a measure of an object's resistance to being deformed elastically when a force is applied to it. Modulus values, as described herein, are measured at 40% stretch across the width of the bra by ASTM D4964 and are expressed in pound-force (lbf) or Newton (N). By applying the strips to the bra material, stretch may be reduced in the areas of application due to the high modulus values of the strips (e.g., the strips resist stretch). Moreover, the hardness of the strips may be modified to increase or decrease the modulus of elasticity of the support strips. For instance, increasing the hardness would increase the modulus of elasticity and decreasing the hardness would decrease the modulus of elasticity. In an exemplary aspect, the hardness of the strips may have a range from 40 Shore A up to 95 Shore A.

Support may also be provided by decreasing the elasticity of the breast cup material on which the support strips overlay. For example, when formed from thermoplastic polyurethane, the support strips may exhibit the property of melting, or partially melting when heated and returning to a solid state when sufficiently cooled. Thus, a thermal bonding process may be used to form a thermal bond between the support strips and the material that forms the bra. Thermal bonding may involve melting or softening the support strips such that the thermoplastic polymer intermingles with the material(s) forming the breast cups. For example, the melting or softening of the thermoplastic polymer may cause the polymer material to extend around or bond with filaments or fibers of yarns that make up the material forming the breast cups. This, in turn, may restrict the movement or stretch of the yarns which limits the overall stretch in the areas to which the support strips are applied. By limiting stretch in these areas, support may be achieved.

The elastomeric support strips may also provide mechanical support to the wearer's breast tissue due to, for instance, the shape configuration of the strips. For instance, the elastomeric support strips may be configured to have different widths and/or thicknesses along their length to provide varying degrees of support, where areas having a greater width and/or thickness may provide a higher level of mechanical support to the wearer's breasts. Any and all such aspects, and any variation thereof, are contemplated as being within the scope herein.

In exemplary aspects, the bra is configured such that at least a portion of the elastomeric support strips are left exposed. In other words, at least a portion of the elastomeric strips are not sandwiched between layers of bra material nor are they covered in any way by bra material. The elastomeric support strips may have, in exemplary aspects, a property (either inherent or applied thereto) such as stickiness and/or a surface texture such as flocking that interact in some way with either an outer shirt material and/or the wearer's skin when the bra is worn. The interaction between the support strips and the outer shirt material may, in aspects, help to keep (i.e., reduce the likelihood) the outer shirt material from shifting or "riding up" during movement. And likewise, the interaction between the strips and the wearer's skin may help to keep the bra from shifting during movement. In another exemplary aspect, the support strips may have a color different from that of the bra to add aesthetic appeal to the bra and/or to act as a visual indicator of, for instance, the level of support provided by the bra.

As described above, the elastomeric support strips may comprise a polyurethane or thermoplastic polyurethane material, a silicone material, a foam material, and the like. One exemplary polyurethane material is produced by Taiwan Kurim Enterprises located in Taichung, Taiwan. In other exemplary aspects, the support strips may be formed of a seam tape, a fabric material, a plastic material, a rubber material, a metal material, and the like. Any and all aspects, and any variation thereof, are contemplated as being within the scope herein. The elastomeric support strips may be attached or affixed to the bra using, for instance, a thermal bonding process, a heat-activated adhesive, stitching, and the like. The elastomeric support strips are configured to have high-abrasion resistance, a soft feel, high UV resistance, as well as a high degree of resistance to degradation due to high or low temperatures.

Turning now to FIG. 1, FIG. 1 illustrates a front perspective view of a person wearing a bra 100 with support strips 116 in accordance with an aspect herein. While aspects discussed herein refer to bras, it will be understood that aspects are not limited to any particular style or type of support garment used to support breast tissue. For example, other support garments may include camisoles, bandeaus, swimwear or other garments with built-in support. Further, the depictions in the drawings are for exemplary purposes only and are in no way meant to limit the scope of the present invention. For instance, although the bra 100 is shown as a pull-over sport bra, the bra 100 may comprise more traditional style bras that include separate breast cups, front closures, back closures, removable shoulder straps, and the like.

Terms used throughout this disclosure such as anterior, posterior, superior, inferior, medial, and lateral are meant to have their common meaning with respect to the bra being worn by a wearer standing in anatomical position.

The material used to form the bra 100 or portions thereof, may comprise knitted or woven materials that exhibit a degree of stretch so as to allow the bra 100 to be easily donned and doffed by, for instance, pulling the bra 100 over the wearer's head. For instance, the material may exhibit between 7 N to 8 N at 40% stretch using standard modulus of elasticity tests. In exemplary aspects, the material may exhibit moisture-management characteristics (i.e., the ability of a fabric to transport moisture from a first surface of the fabric to a second surface of the fabric). In exemplary aspects, the material may comprise 80% polyester/20% spandex, 85% polyester/15% spandex, 88% polyester/12% spandex, 90% polyester/10% spandex, or materials having ratios of polyester and spandex between these values or above and below these values.

The bra 100 comprises at least a front portion or region 110, breast cups 112, shoulder straps 114, support strips 116, a back portion or region (not shown in FIG. 1), and an optional underband 118. The front region 110 is configured to overlay a front upper torso area of the wearer, and the breast cups 112 are configured to overlay the breast area of the wearer. As used throughout this disclosure, the term "breast cups" is meant to be construed broadly to mean that portion of the bra configured to overlay a wearer's breasts when worn. The breast cups 112 may be structured or unstructured, molded or unmolded, and/or single-layered or multi-layered. The shoulder straps 114 are configured to overlay a shoulder area of the wearer and may have a number of different configurations such as racerback, convertible, standard, and the like. The back region is configured to overlay a back upper torso area of the wearer and may be connected to the front region 110 in part through the shoulder straps 114. The optional underband 118 is configured to encircle the wearer's torso at a lower or inferior margin of the bra 100. As well, the bra 100 may have a front closure, a back closure, or the bra 100 may be donned and doffed by pulling the bra 100 over the wearer's head.

As mentioned, the front region 110 of the bra 100 is the portion of the bra 100 that covers a portion of the torso of the wearer including the wearer's breasts. The front region 110 may include the pair of breast cups 112 which, in some aspects, may be unstructured or may be structured or constructed such that they conform generally to the shape of the wearer's breasts (e.g., by molding the pair of breast cups). In aspects, the breast cups 112 may be formed from one or more layers of material. By way of example, the breast cups 112 may comprise an inner liner layer or inner-facing layer that comes in contact with the wearer's skin when the bra 100 is worn, and an external shell layer or outer-facing layer that is on the exterior of the bra 100 when the bra 100 is worn. The breast cups 112 may optionally comprise one or more middle layers sandwiched between the inner liner layer and the external shell layer. In another exemplary aspect, the breast cups 112 may comprise a single layer of material having an outer-facing surface that faces the external environment when the bra 100 is worn and an inner-facing surface that faces the wearer's skin when the bra 100 is worn. Any and all aspects, and any variation thereof, are contemplated as being within aspects herein.

The support strips 116 may comprise flexible elastomeric support strips that are affixed on the outer-facing surface of the breast cups 112. As used throughout this disclosure, the term "flexible" implies that the strips can deform or flex in an x-direction, a y-direction, and a z-direction in response to a tensioning force and return to a resting state when the tensioning force is removed. As shown in FIG. 1, in one exemplary configuration, the strips 116 are affixed generally along a lower margin of the breast cups 112 and have a generally curved shape. Using the support strip 116 positioned on the left side of the bra 100 as a representative example, the support strip 116 may have a first end 120 located at a lateral portion of the bra 100 such that the first end 120 is generally positioned along the mid-axillary line of the wearer when the bra 100 is worn. The strip 116 may further have a second end 122 located at a medial portion of the bra close to a hypothetical vertical midline that divides the bra 100 into equal right and left halves. The support strip 116 further comprises an intervening portion 124 extending between the first and second ends 120 and 122 that curves towards the lower margin of the bra 100 such that it is generally positioned inferior to the wearer's breasts when the bra 100 is worn. Such a configuration provides support to the under portions and/or the lateral and medial portions of the wearer's breasts when the bra 100 is worn. In exemplary aspects, application of the support strips 116 to the bra 100 may reduce stretch to zero or near zero at 40% stretch in the areas to which they are applied.

Figure 6:
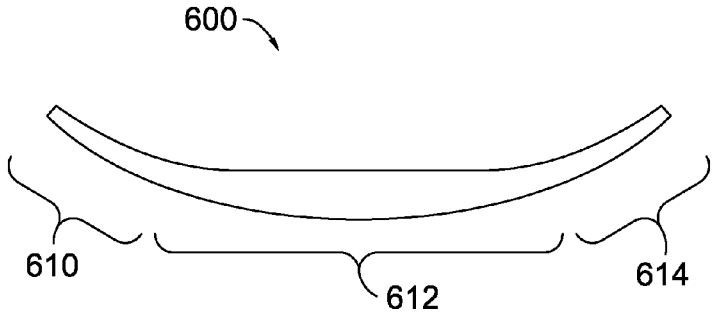
FIGS. 6-8 illustrate top-down plan views of exemplary elastomeric support strips used to provide support portions to a bra in accordance with aspects herein.

The support strips 116 are shown as having a uniform width in FIG. 1. The width shown in FIG. 1 is exemplary only, and it is contemplated that the width of the strips 116 may be greater than or less than the width shown in FIG. 1. Exemplary widths may comprise, for instance, between 2 mm and 10 mm although widths above and below these values are contemplated herein. Further, it is contemplated herein that the strips 116 may have varying widths along different portions of the strips 116. In one example, the strips 116 may be wider along the middle portion of the strips 116. This aspect is illustrated in FIG. 6 which depicts a top-down plan view of an elastomeric support strip 600 that is unaffixed to a bra. The support strip 600 comprises a first end 610, a second end 614, and an intervening portion 612 extending between the two ends 610 and 614. The intervening portion 612 has a greater width as compared to the first end 610 and the second end 614. When affixed to a bra, the intervening portion 612 of the support strip 600 would be located under the wearer's breasts when the bra is worn and would provide a high level of mechanical support to this area (i.e., it would act as a shelf upon which the breast tissue can rest). Although not shown in FIG. 6, the intervening portion 612 may also have a greater degree of hardness than the first and second ends 610 and 614 to provide even greater support.

Figure 7:
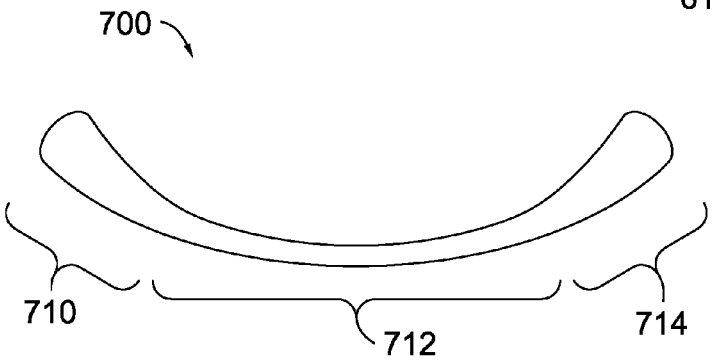
Figure 8:
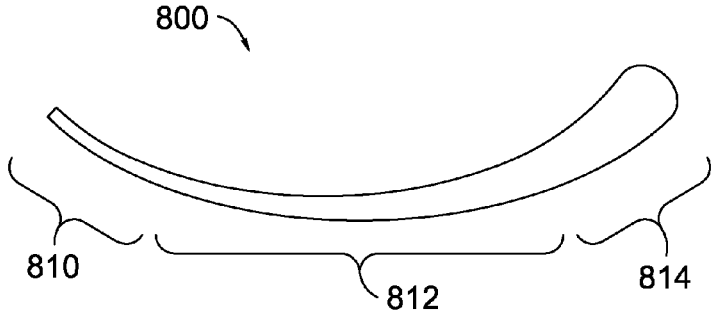

In another example, the first and/or second ends 120 and/or 122 of the strips 116 may be wider to reduce lateral-to-medial swaying of the wearer's breast when the bra 100 is worn. These aspects are illustrated in FIGS. 7 and 8 which depict top-down plan views of exemplary elastomeric support strips 700 and 800 respectively in accordance with aspects herein, where the support strips 700 and 800 are unaffixed to a bra. With respect to FIG. 7, the elastomeric support strip 700 comprises a first end 710, a second end 714, and an intervening portion 712 extending between the two ends 710 and 714. In this aspect, the first end 710 and the second end 714 have a greater width as compared to the intervening portion 712. When affixed to a bra, the first and second ends 710 and 714 would be located along the medial and lateral sides of the wearer's breasts when the bra is worn and would provide a high level of support to these areas. This may be useful in athletic activities that result in a medial-to-lateral swaying of the wearer's breasts. Although not shown in FIG. 7, the first and second ends 710 and 714 may also have a greater degree of hardness than the intervening portion 712 to provide even more support.

Continuing, the elastomeric support strip 800 of FIG. 8 comprises a first end 810, a second end 814, and an intervening portion 812 extending between the two ends 810 and 814. In this aspect, the second end 814 has a greater width than either the first end 810 or the intervening portion 812. The wider second end 814 may be positioned on either a medial side of the breast cup or the lateral side of the breast cup to provide greater support to the medial portions or the lateral portions of the wearer's breasts respectively when the bra is worn. Elastomeric support strips that combine features of FIGS. 6, 7, and 8 are further contemplated herein. Any and all such aspects, and any variation thereof, are contemplated as being within the scope herein.

Turning back to FIG. 1, as explained, the support strips 116 may have differing degrees of hardness along their length to provide differing modulus of elasticity values along the length of the strips 116. For instance, the strips 116 may have a higher degree of hardness, and subsequently a higher modulus of elasticity, in areas configured to provide greater support to the wearer's breasts. In one example, the intervening portion 124 of the strips 116 may have a greater degree of hardness so as to provide greater support to the under portions of the wearer's breasts when the bra 100 is worn. In another example, the strips 116 may have a higher degree of hardness towards the first and/or second ends 120 and/or 122 of the strips 116 to provide a greater level of support to the medial and/or lateral portions of the wearer's breasts when the bra 100 is worn. Any and all such aspects, and any variation thereof, are contemplated as being within the scope herein.

Additionally, the support strips 116 may have different thicknesses along their length. Exemplary thicknesses may comprise between 2 mm and 10 mm although values above and below these are contemplated herein. For instance, the support strips 116 may be thicker in areas adapted to provide greater support. In a first example, the support strips 116 may be thicker along the intervening portion 124 of the strips 116 to provide greater support to the under portions of the wearer's breasts when the bra 100 is worn. In a second example, the support strips 116 may be thicker towards the first and/or second ends 120 and/or 122 of the strips 116 to provide greater support to the medial and/or lateral portions of the wearer's breasts when the bra 100 is worn.

Figure 11:
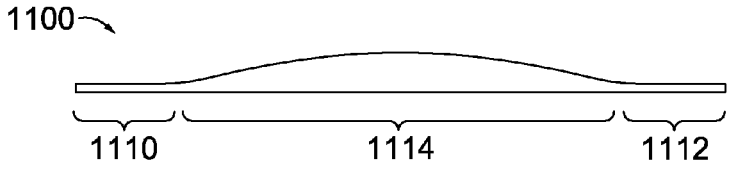
FIGS. 11-13 illustrate side plan views of exemplary elastomeric support strips used to provide support portions to a bra in accordance with aspects herein.
Figure 12:
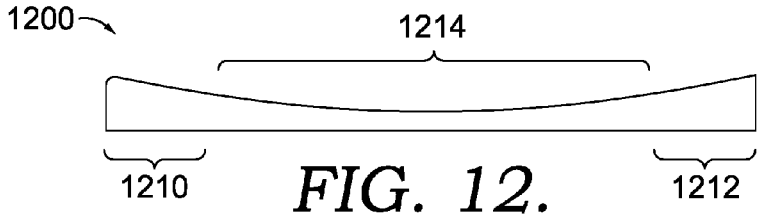
Figure 13:
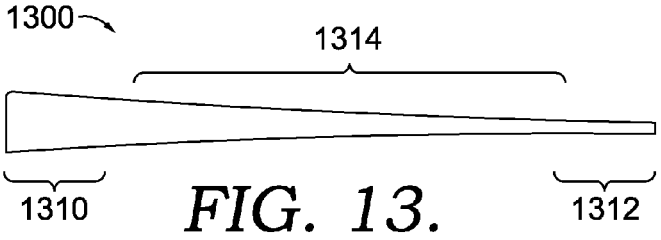

This aspect is illustrated in FIGS. 11-13 which depict side plan views of exemplary elastomeric support strips 1100, 1200, and 1300 respectively in accordance with aspects herein, where the support strips 1100, 1200, and 1300 are unaffixed to a bra. With respect to FIG. 11, the support strip 1100 comprises a first end 1110, a second end 1112, and an intervening portion 1114 extending between the first and second ends 1110 and 1112. The intervening portion 1114 has a greater thickness than the first and second ends 1110 and 1112. When incorporated into a bra, the intervening portion 1114 is positioned under the wearer's breast, and its increased thickness can act as a shelf-type structure to support the wearer's breast tissue in this area.

With respect to FIG. 12, the support strip 1200 comprises a first end 1210, a second end 1212, and an intervening portion 1214 extending between the first and second ends 1210 and 1212. The first and second ends 1210 and 1212 have an increased thickness as compared to the intervening portions 1214. When incorporated into a bra, the increased thickness of the first and second ends 1210 and 1210 may help to provide structural support to the medial and lateral portions of the wearer's breasts and thus help to minimize medial-to-lateral sway of the wearer's breasts. FIG. 13 depicts the support strip 1300 having a first end 1310, a second end 1312, and an intervening portion 1314 extending between the first and second ends 1310 and 1312. The first end 1310 has an increased thickness as compared to the intervening portion 1314 and the second end 1312. When incorporated into a bra, the first end 1310 may be positioned at a medial or a lateral side of the bra to provide increased structural support to the medial or lateral portions of the wearer's breasts and to minimize sway of the wearer's breasts. Any and all such aspects, and any variation thereof, are contemplated as being within the scope herein.

Figure 2A:
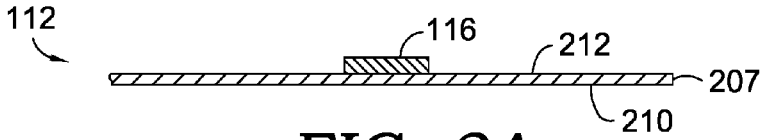
FIG. 2A-2B illustrate exemplary cross-sectional views of the exemplary bra of FIG. 1 taken along cut line 2A-2A and depict the elastomeric support strip affixed to the outer-facing surface of the breast cup in accordance with an aspect herein.

Returning now to FIG. 1, FIG. 2A is an exemplary cross-section of the bra 100 taken along cut line 2A-2A of FIG. 1 and illustrates how the support strip 116 is affixed to an outer-facing surface of the breast cup 112. FIG. 2A depicts the breast cup 112 comprising a single layer of material 207 having an outer-facing surface 212 and an inner-facing surface 210. As shown, the support strip 116 is affixed (e.g., thermally bonded) to the outer-facing surface 212 of the single layer of material 207 such that it is exposed to the external environment. To put it another way, when the breast cup 112 is formed from the single layer of material 207, the strip 116 is not sandwiched between different layers of bra material nor is it covered by any layer of bra material.

Figure 2B:
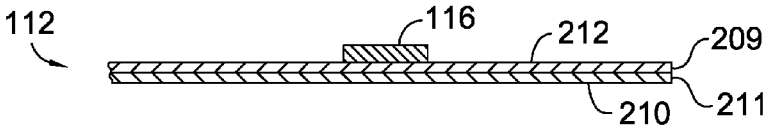

FIG. 2B is another exemplary cross-section of the bra 100. FIG. 2B depicts the breast cup 112 comprising a first layer of material 209 and a second layer of material 211. The two-layered material 209/211 comprises the outer-facing surface 212 and the inner-facing surface 210. As shown, the support strip 116 is affixed (e.g., thermally bonded) to the outer-facing surface 212 of the two-layered material 209/211 such that it is exposed to the external environment. In exemplary aspects, the entirety, or a portion thereof, of the strip 116 may be exposed to the external environment. For instance from 1% to 100% of the strip 116 may be exposed to the external environment. To put it another way, at least a portion of the strip 116 is not sandwiched between different layers of bra material nor is it covered by any layer of bra material. It is contemplated herein that more than two layers of material may be used.

Figure 3:
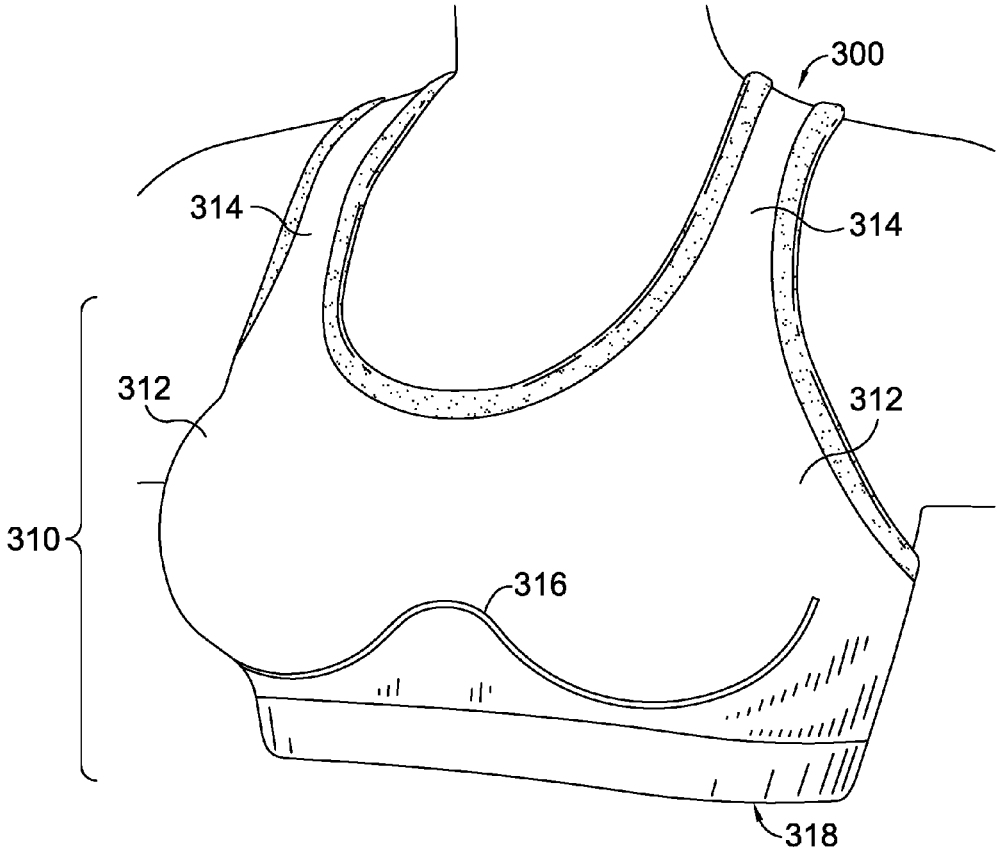
FIG. 3 illustrates a front perspective view of an exemplary bra having a single elastomeric support strip affixed to an outer-facing surface of the breast cups in accordance with an aspect herein.

FIG. 3 illustrates another exemplary configuration for the elastomeric support strip in accordance with an aspect herein. FIG. 3 depicts a front perspective view of a bra 300 being worn by a wearer, where the bra 300 comprises a front region 310, breast cups 312, shoulder straps 314, an optional underband 318, an elastomeric support strip 316, and a back region (not shown). The elastomeric strip 316 comprises a single support strip that is affixed to an outer-facing surface of the breast cups 312. In this configuration, the strip 316 extends across the front midline of the bra 300. Similar to the elastomeric support strips 116 of FIG. 1, the support strip 316 may have varying widths, thicknesses, and/or degrees of hardness along its length to provide customized support to the wearer's breasts when the bra 300 is worn. Moreover, although at least a portion of the strip 316 is exposed, other portions may be overlaid by one or more layers of material.

Figure 10:
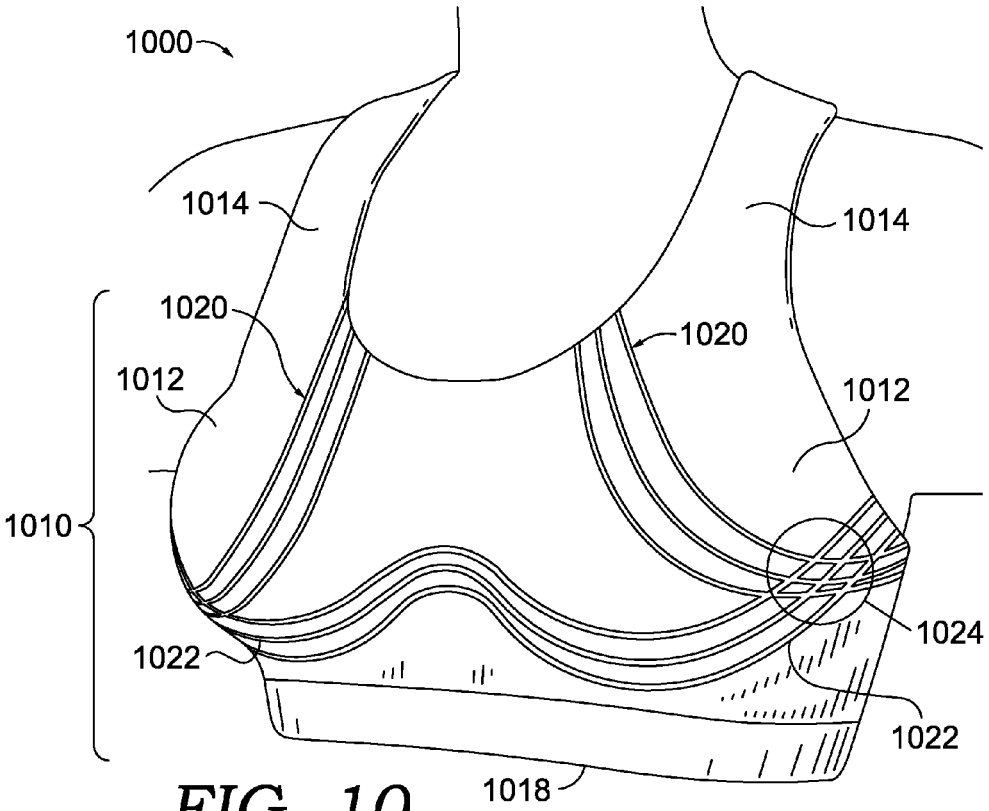
FIG. 10 illustrates a front perspective view of an exemplary bra having elastomeric support strips affixed to an outer-facing surface of the breast cups in accordance with an aspect herein.

FIG. 10 depicts an alternative configuration for the elastomeric support strips described herein. FIG. 10 is a front perspective view of an exemplary bra 1000 having elastomeric support strips in accordance with aspects herein. The bra 1000 comprises at least a front region 1010 having breast cups 1012, an optional underband 1018, and shoulder straps 1014 that help to secure the front region 1010 to a back region (not shown) of the bra 1000.

The bra 1000 comprises a plurality of elastomeric support strips. For instance, the bra 1000 may comprises a first set of elastomeric support strips 1020 that generally extend from a medial edge of the shoulder straps 1014 to lateral sides of the bra 1000. The bra 1000 may further comprise a second set of elastomeric support strips 1022 that generally extend from a first lateral side of the bra 1000 to the opposing lateral side of the bra 1000. The elastomeric support strips 1022 are generally configured to curve towards the bottom margin of the bra 1000 such that they curve under the wearer's breasts when the bra 1000 is worn. In exemplary aspects, and as shown in FIG. 10, the elastomeric support strips 1022 extend across the midline of the bra 1000. It is contemplated herein that the elastomeric support strips 1022 do not extend across the midline and, instead, comprise two separate sets of support strips positioned generally under each of the breast cups 1012.

In exemplary aspects, the first set of support strips 1020 may help to provide support to the shoulder straps 1014 of the bra 1000. As explained above, the support strips 1020 may provide support by virtue of having a high modulus of elasticity and/or by limiting stretch in the areas over which they overlay (via, for instance, forming a thermal bond with the material forming the shoulder straps 1014). In exemplary aspects, stretch in the areas where the support strips 1020 are positioned may exhibit zero or nearly zero stretch at 40% stretch. By using multiple support strips 1020, stretch may be reduced to a greater degree than by using, for instance, a single support strip. The support strips 1020 in exemplary aspects, may comprise varying widths, thicknesses, and/or degrees of hardness. Moreover, in some exemplary aspects, a portion of the support strips 1020 may be overlaid by one or more layers of bra material.

Continuing, in exemplary aspects, the second set of support strips 1022 may help to provide support to the medial, lateral and under portions of the wearer's breasts by, for instance, limiting stretch in the areas over which the strips 1022 overlay and/or by providing structural support based on the thickness, width, and/or hardness of the support strips 1022. In exemplary aspects, stretch in the areas where the support strips 1020 are positioned may exhibit zero or nearly zero stretch at 40% stretch. Similar to above, by using multiple support strips 1022, a greater degree of support may be provided as opposed to using, for instance, a single support strip. The support strips 1022 in exemplary aspects, may comprise varying widths, thicknesses, and/or degrees of hardness. Moreover, in some exemplary aspects, a portion of the support strips 1022 may be overlaid by one or more layers of bra material.

Reference numeral 1024 indicates an area where the first set of support strips 1020 intersect with the second set of support strips 1022. The right side of the bra 1000 would have a similar intersection area (not seen in whole because of the perspective view of FIG. 10). The intersection area 1024 may represent an area of higher support (e.g., zero or nearly zero stretch at 40% stretch) due to the confluence of the first and second sets of support strips 1022 and 1024. In exemplary aspects, stretch in the intersection area 1024 may be further reduced as compared to the areas having the support strips 1020 and the support strips 1022. By locating the intersection area 1024 as shown, the increased support in this area may help to lessen medial-to-lateral sway of the wearer's breasts.

The configuration shown in FIG. 10 is exemplary only, and it is contemplated herein that the support strips 1020 and 1022 may be arranged in different configurations to provide different regions of support. Moreover, it is contemplated herein that the support strips 1020 and 1022 may be configured to provide additional intersection areas with their heightened level of support or lockout. Any and all aspects, and any variation thereof, are contemplated as being within the scope herein.

Figure 4:
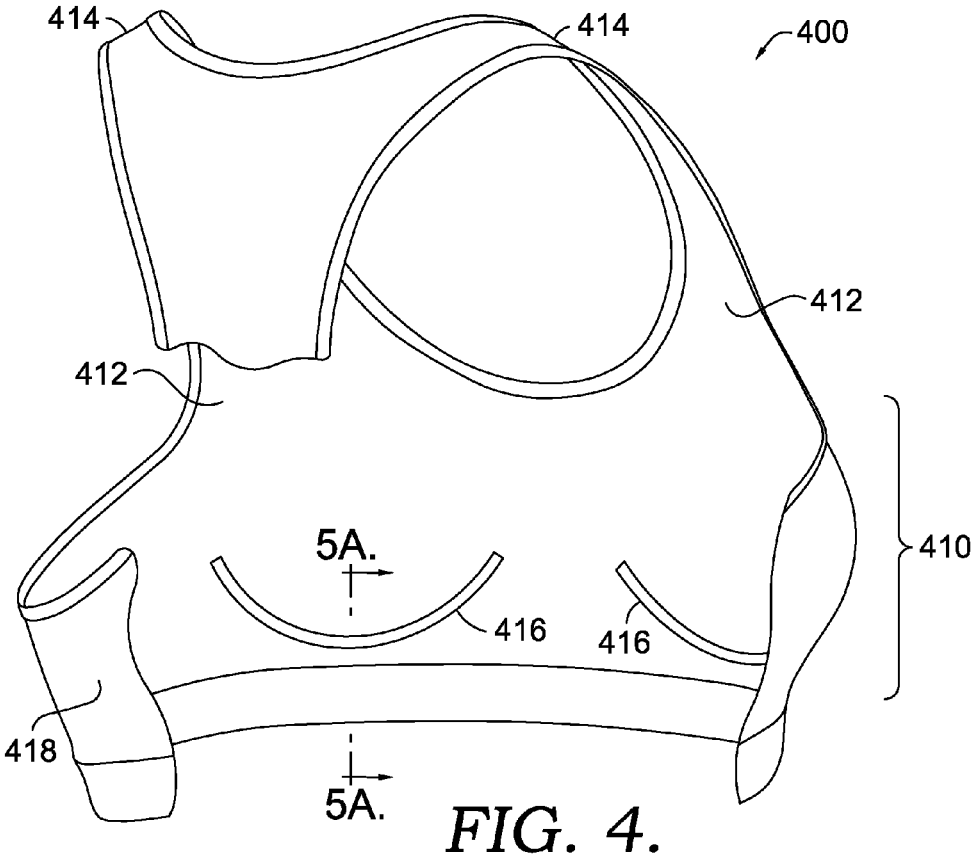
FIG. 4 illustrates a cut-away back view of an exemplary bra having elastomeric support strips affixed to an inner-facing surface of the breast cups in accordance with an aspect herein.

FIG. 4 illustrates a cut-away back view of a bra 400 in accordance with aspects herein. The bra 400 comprises at least a front region 410, a pair of breast cups 412, a pair of shoulder straps 414, elastomeric support strips 416, a back region 418, and an optional underband. The bra 400 is shown partially disassembled in that the shoulder straps 414 are shown unaffixd to the back region 418 and the back region 418 is cut away to provide a view of the inner-facing surface of the breast cups 412. As shown, the elastomeric support strips 416 are affixed to the inner-facing surface of the breast cups 412 such that they are directly adjacent to the wearer's skin when the bra 400 is worn. However, at least a portion of each strip 416 may be overlaid by one or more layers of bra material. The configuration of the strips 416 is similar to that of the strips 116 of FIG. 1. Another exemplary configuration may comprise a single strip that extends across a front midline of the breast cups 412 similar to that shown in FIG. 3. An additional configuration may comprise multiple strips that either extend or do not extend across the midline of the breast cups 412. Any and all aspects, and any variation thereof, are contemplated as being within the scope herein.

Similar to the elastomeric support strips 116 of FIG. 1, the strips 416 may have different widths, thicknesses, and/or different degrees of hardness along their length to provide added support to the wearer's breasts when the bra 400 is worn. For example, and as shown with respect to FIGS. 6-8 and 11-13, the middle portions of the strips 416 may have a greater width, thickness, and/or a greater degree of hardness compared to the remaining portions of the support strips 416 in order to provide greater support to the under portions of the wearer's breasts. In another example, one or both of the ends of the support strips 416 may be wider, thicker, and/or have a greater degree of hardness than other portions to provide more support to the lateral and/or medial portions of the wearer's breasts when the bra 400 is worn.

Figure 5A:
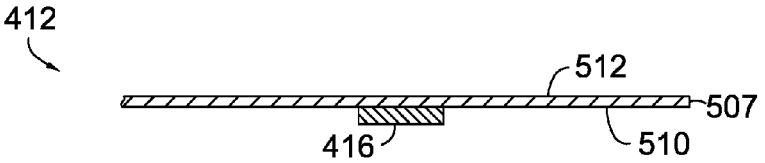
FIGS. 5A-5B illustrate exemplary cross-sectional views of the exemplary bra of FIG. 4 taken along cut line 5A-5A and depicting the elastomeric support strip affixed to the inner-facing surface of the breast cup in accordance with an aspect herein.

FIG. 5A depicts a cross-section of the bra 400 taken along cut line 5A-5A in accordance with an aspect herein. FIG. 5A illustrates how the breast cup 412 may be formed of a single layer of material 507, and the support strip 416 is affixed to an inner-facing surface 510 of the material 507. More particularly, FIG. 5 depicts an outer-facing surface 512 of the material 507 and the inner-facing surface 510 of the material 507. As shown, the support strip 416 is affixed to the inner-facing surface 510 of the material 507 such that it is adjacent to a wearer's skin when the bra 400 is worn. To put it another way, since the breast cup 412 comprises the single layer of material 507, the strip 416 is not sandwiched between different layers of bra material nor is it covered by any layer of bra material.

Figure 5B:
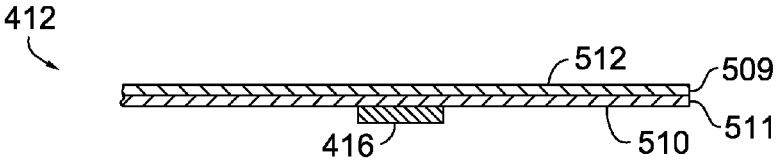

FIG. 5B depicts an alternative configuration where the breast cup 412 is formed of two layers of material 509 and 511. The two layers of material 509/511 have an outer-facing surface 512 and an inner-facing surface 510. As shown, the support strip 416 is affixed to the inner-facing surface 510 of the two layers of material 509/511 such that it is adjacent to a wearer's skin when the bra 400 is worn. However, in some exemplary aspects, at least a portion of the support strip 416 may be overlaid by one or more layers of bra material.

In exemplary aspects, the support strips described herein, such as the support strips 116, 316, 416, 600, 700, 800, 1020, 1022, 1100, 1200, and/or 1300 may possess an intrinsic property or be modified or treated such that the exposed surface of the strips exhibit a surface roughness, texture, and/or stickiness that enables the strips to interact in some way with an outer layer of clothing (when the strips are positioned on an outer-facing surface of the breast cups) and/or with a wearer's skin surface (when the strips are positioned on an inner-facing surface of the breast cups). For instance, flocking may be applied to the strip surface to impart a slight roughness to the strip surface. When positioned adjacent to an outer layer of clothing, the support strips may help to reduce the likelihood of the outer layer from "riding up" or substantially shifting during activity. When positioned adjacent to a skin surface of the wearer, the support strips may help to reduce the likelihood of the bra from shifting during activity.

Figure 9:
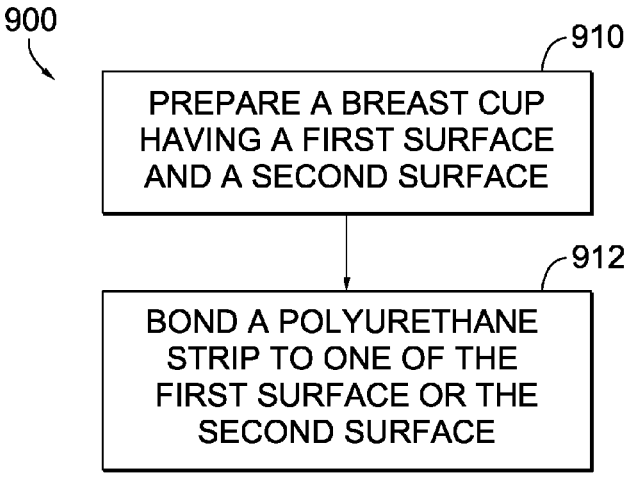
FIG. 9 illustrates a flow diagram of an exemplary method of making a breast cup having one or more support portions in accordance with an aspect herein.

FIG. 9 depicts a flow diagram of an exemplary method 900 of making a breast cup having support portions as described herein. At a step 910, one or more layers of material used to form a breast cup are prepared. When more than one layer of material is used, the layers of material may be prepared by cutting and affixing the different layers to each other using affixing technologies such as stitching, adhesives, welding, bonding, and the like. After preparation, the breast cup comprises an outer-facing surface and an inner-facing surface.

At a step 912, one or more polyurethane strips are affixed to one of the outer-facing surface of the breast cup, the inner-facing surface of the breast cup, and/or to both the outer-facing surface and the inner-facing surface of the breast cup. Affixing may comprise thermal bonding, mechanical bonding, chemical bonding, using a heat-activated adhesive, stitching, and the like. In one exemplary aspect, a liquid form of the polyurethane material may be placed in a mold, and the bra material is positioned on top of the polyurethane. Once positioned, the polyurethane is affixed to the material by using one or more of pressure, heat, ultraviolet light, and the like. As described above, the polyurethane strip may be bonded to the medial, lateral, and lower margins of the breast cup as well as at the upper margins of the breast cup. The breast cup may then be incorporated into a bra.

Additional ways of making a breast cup having support portions are contemplated herein. For instance, one or more layers of material of the breast cup are prepared similar to step 910 of the method 900. The support portions may then be formed at the lower margins of the breast cups by using a screen printing process to gradually build different layers of elastomeric material. Moreover, the screen printing process may be adapted to generate different thicknesses and/or widths of the support strips to provide customized support.

Aspects of the present invention have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A breast cup comprising:

a first surface and a second surface opposite the first surface, wherein the second surface is configured to face a wearer in an as-worn configuration;

a first set of one or more flexible elastomeric support strips affixed to a first area along a lower margin of the first surface of the breast cup; and a second set of one or more flexible elastomeric support strips affixed to a second area of the first surface of the breast cup that is different from the first area, wherein the first set of one or more flexible elastomeric support strips intersects the second set of one or more flexible elastomeric support strips at an intersection area.

2. The breast cup of claim 1, wherein the first set of one or more flexible elastomeric support strips and the second set of one or more flexible elastomeric support strips comprise flocking applied thereto.

3. The breast cup of claim 1, wherein the first set of one or more flexible elastomeric support strips and the second set of one or more flexible elastomeric support strips comprise one or more of a thermoplastic polyurethane material, a silicone material, or a foam material.

4. The breast cup of claim 1, wherein the first set of one or more flexible elastomeric support strips and the second set of one or more flexible elastomeric support strips comprise a uniform hardness.

5. The breast cup of claim 1, wherein at least one flexible elastomeric support strip of the first set of one or more flexible elastomeric support strips and the second set of one or more flexible elastomeric support strips comprises at least a first portion having a first hardness and a second portion having a second hardness greater than the first hardness.

6. An article of apparel comprising:

a front region comprising at least a pair of breast cups, each breast cup having an outer-facing surface and an opposite inner-facing surface, wherein the inner-facing surface faces a wearer in an as-worn configuration, the each breast cup further comprising a first set of one or more support strips of an elastomeric material having a curved shape, wherein the first set of one or more support strips are affixed to a first area along a bottom margin of the outer-facing surface of the each breast cup, and a second set of one or more support strips affixed to a second area of the outer-facing surface of the each breast cup that is different from the first area, wherein the first set of one or more support strips and the second set of one or more support strips intersect at an intersection area; and a back region attached to the front region of the bra.

7. The article of apparel of claim 6, wherein a first portion of at least one support strip in the first set of the one or more support strips or at least one support strip in the second set of the one or more support strips comprises a first thickness and a second portion of the at least one support strip in the first set of the one or more support strips or the at least one support strip in the second set of the one or more support strips comprises a second thickness greater than the first thickness.

8. The article of apparel of claim 6, wherein a first portion of at least one support strip in the first set of the one or more support strips or at least one support strip in the second set of the one or more support strips comprises a first hardness and a second portion of the at least one support strip in the first set of the one or more support strips or the at least one support strip in the second set of the one or more support strips comprises a second hardness greater than the first hardness.

9. The article of apparel of claim 6, wherein a first portion of at least one support strip in the first set of the one or more support strips or at least one support strip in the second set of the one or more support strips comprises a first width and a second portion of the at least one support strip in the first set of the one or more support strips or the at least one support strip in the second set of the one or more support strips comprises a second width greater than the first width.

10. The article of apparel of claim 6, wherein at least one support strip in the first set of the one or more support strips or at least one support strip in the second set of the one or more support strips comprises flocking applied thereto.

11. The article of apparel of claim 6, wherein the back region is attached to the front region by at least a pair of shoulder straps.

12. An article of apparel comprising:

a front region comprising at least a pair of breast cups, each breast cup having an outer-facing surface that is opposite an inner-facing surface, the inner-facing surface facing a wearer in an as-worn configuration, the each breast cup further comprising a first set of a first plurality of flexible elastomeric support strips positioned and affixed to a first area of the each breast cup along a bottom margin of the outer-facing surface of the each breast cup and a second set of a second plurality of flexible elastomeric support strips positioned and affixed to a second area of the each breast cup different from the first area, wherein the first set of the first plurality of flexible elastomeric support strips intersect with the second set of the second plurality of flexible elastomeric support strips at an intersection area;

a back region; and a pair of shoulder straps that connect in part the front region to the back region.

13. The wire free article of apparel of claim 12, wherein the first plurality of flexible elastomeric support strips in the first set and the second plurality of flexible elastomeric support strips in the second set are one or more of thermally bonded or bonded using an adhesive to the outer-facing surface of the each breast cup.

14. The article of apparel of claim 13, wherein non-bonded portions of the first plurality of flexible elastomeric support strips in the first set or the second plurality of elastomeric support strips in the second set have a surface treatment applied thereto.

15. The article of apparel of claim 14, wherein the surface treatment comprises flocking.

16. The article of apparel of claim 12, wherein the second area is located along lateral portions of the each breast cup.

* * * * *